United States Patent [19]

Zens

[11] 4,226,404

[45] Oct. 7, 1980

[54] UNIVERSAL LONG STROKE PUMP SYSTEM

[75] Inventor: Rene J. L. Zens, Houston, Tex.

[73] Assignee: Michael P. Breston, Houston, Tex. ; a part interest

[21] Appl. No.: 775,065

[22] Filed: Mar. 7, 1977

[51] Int. Cl.[2] ..... B66C 23/72

[52] U.S. Cl. ..... 254/359; 187/94; 254/361

[58] Field of Search ..... 254/178, 186 R, 175.7, 254/150 R; 74/89.22, 590; 166/72

[56] References Cited

U.S. PATENT DOCUMENTS

| | | | |
|---|---|---|---|
| 3,285,081 | 11/1966 | Kuhns et al. | 254/174 |
| 3,524,606 | 8/1970 | Coski | 254/186 R |
| 3,690,409 | 9/1972 | Brauss | 254/186 R |
| 4,076,218 | 2/1978 | Gault | 254/178 |

*Primary Examiner*—Kenneth W. Noland
*Attorney, Agent, or Firm*—Michael P. Breston

[57] ABSTRACT

The long-stroke pumping apparatus has a frame, a drum, and a pair of sheaves mounted on the frame. A traction cable is carried by the drum. A cable connector is connected to one end of the traction cable which is guided over one sheave into an oil well. A counterweight assembly is connected to the other end of the traction cable which is guided over the other sheave into a counterweight well. A reversible power means, preferably a hydraulic motor, rotates the drum a number of turns in one angular direction and then in an opposite direction during one complete stroke of pumping operation. A load cable is also supported and guided by the sheaves, and the cable connector and the counterweight assembly are also suspended from the opposite ends of the load cable. The load cable is not drivingly connected to the drum.

27 Claims, 16 Drawing Figures

FIG. 5.
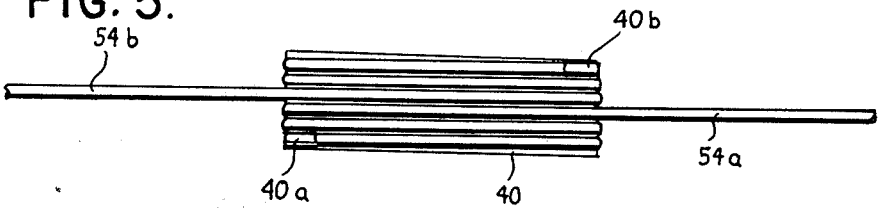
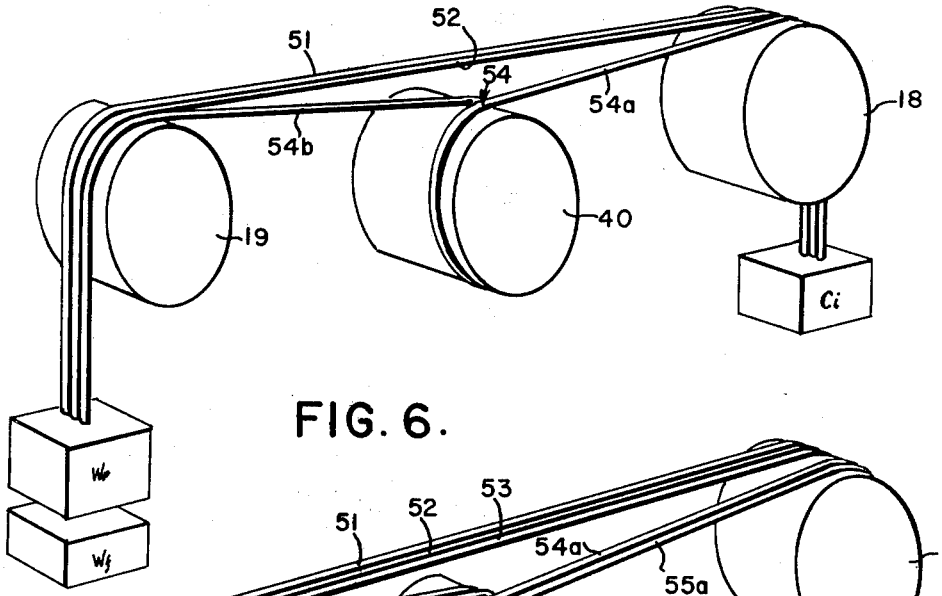
FIG. 6.
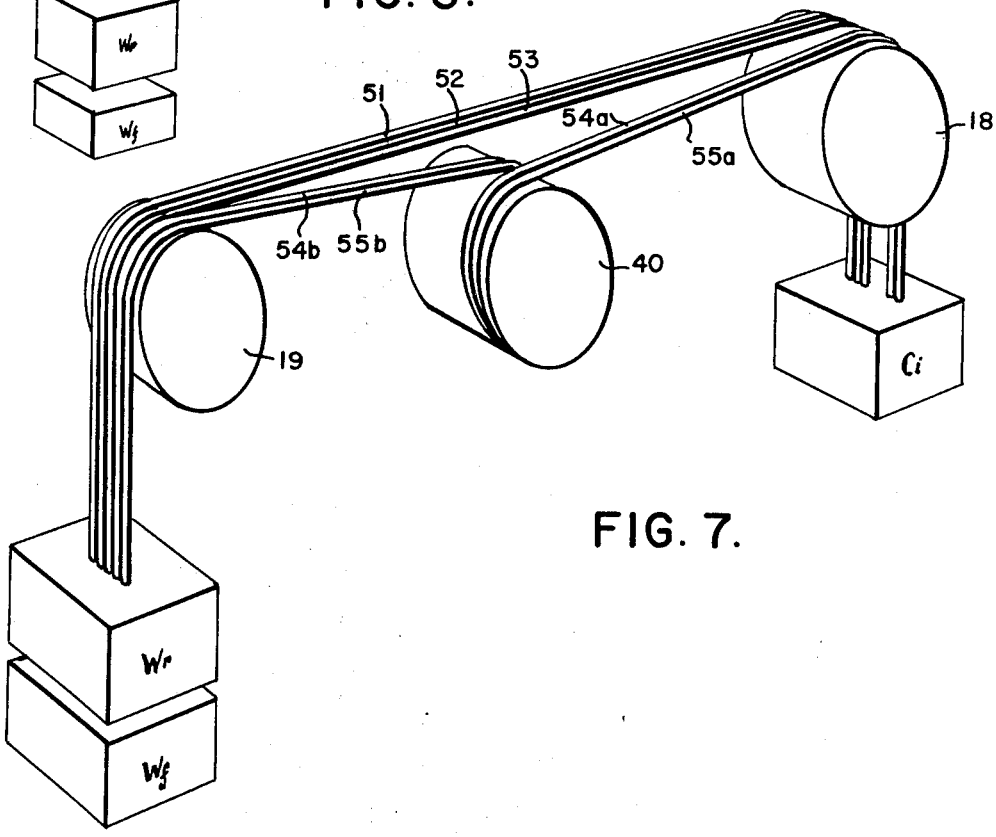
FIG. 7.

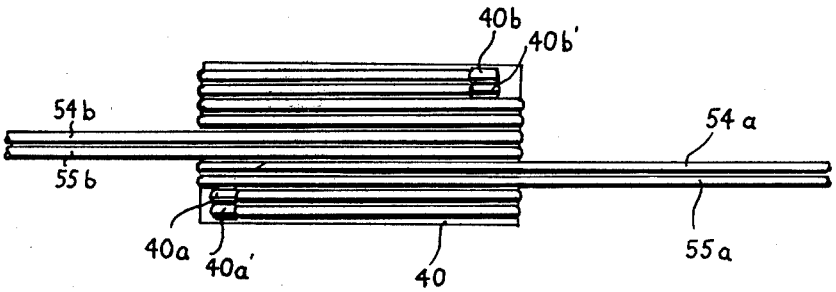
FIG. 8.
FIG. 9A.
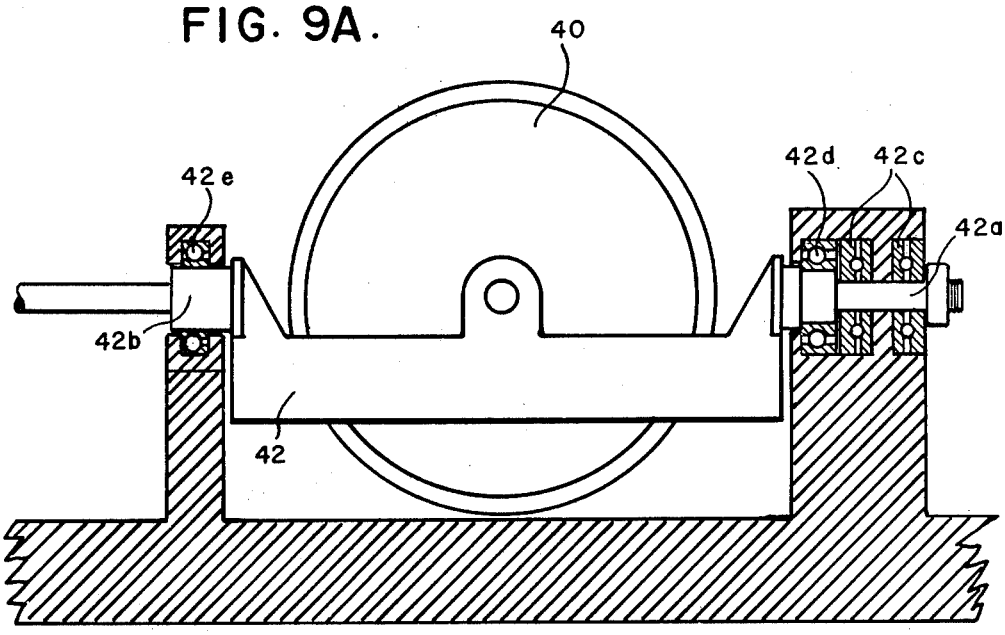

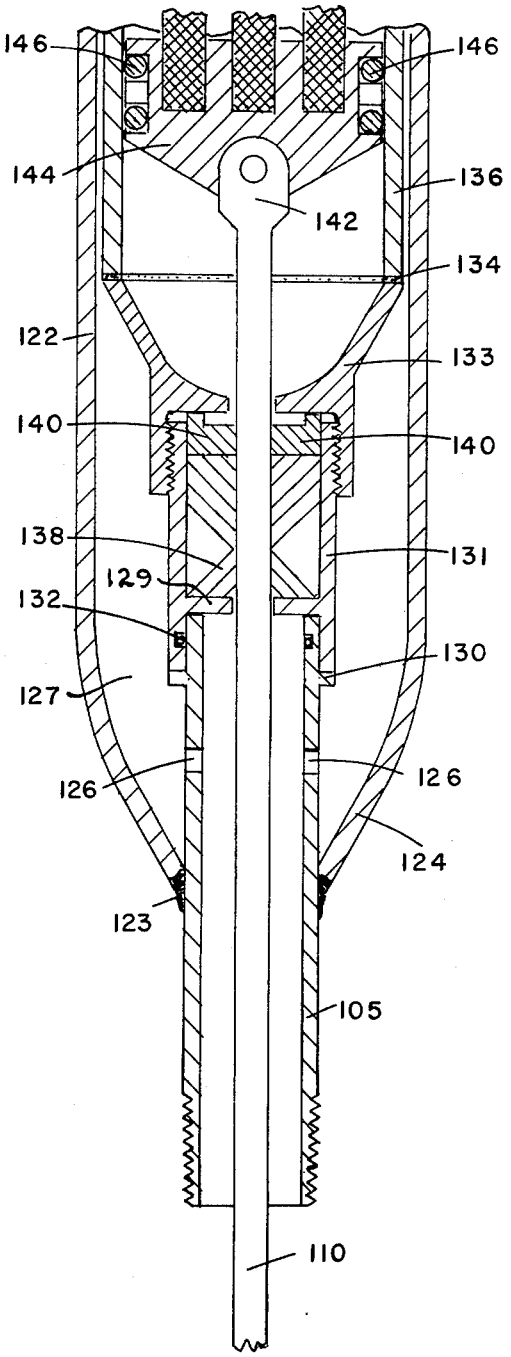
FIG. 12.
FIG. 14.
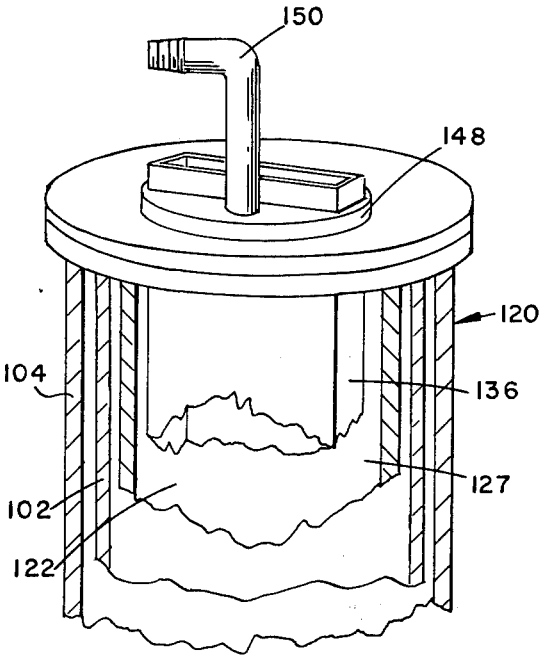
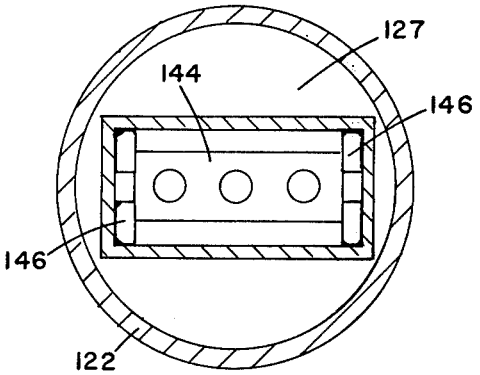
FIG. 13.

UNIVERSAL LONG STROKE PUMP SYSTEM

BACKGROUND OF THE INVENTION (a) Field of the Invention

This invention generally relates to a long stroke pumping apparatus for oil wells and the like and more particularly to a multi-cable universal long stroke pumping apparatus.

(b) Description of the Prior Art

A beam-type pumper is generally limited to a stroke length of about 16 to 18 feet. The string of sucker rods accelerate from the start of each stroke to the middle and decelerate from there to the end of the stroke. It was long recognized that a longer stroke and a slower but constant speed for the sucker rods would be an improvement. Efforts have therefore been made to build long-stroke pumpers. For example, U.S. Pat. Nos. 3,285,081 and 3,528,305 describe one such pumper.

Another long-stroke pumper is described in the November, 1976 issue of World Oil, Pages 64–68. It is cable-operated by an electronically-controlled electric motor. It utilizes a drum on which a first cable is wound in one direction to raise and lower the rod string. A second cable also connected to the drum is pulled in the opposite direction by a counterweight which partially balances the torque load required to lift the rod string and the production fluid from the well. The steel wire cables wound on the drum have a large diameter and require large diameter sheaves. The drum itself is rotated by a high-torque gear box driven by the electric motor which is mechanically switched to operate in forward and reverse for up and down strokes. The drum's surface is provided with spiraling grooves, or cams, which cause the cables to follow paths that change the radius of the drum near the end of each stroke, thereby altering respective torque loads on the well-side and on the counterweight-side cables. As a result, the counterweight-torque is decreased by a smaller radius and the upward motion will stop and reverse. Similarly, at the bottom of the stroke, the well-side torque is decreased by a smaller radius and the downward motion will stop and reverse. During a portion of this pendulum type motion, the electric motor is switched off, otherwise it is required to supply power over most of the length of each stroke. The direction of rotation of the motor is controlled by conventional mechanical reversing contactors that are actuated by an electronic system. At the proper time during each stroke, the motor is switched off or on as required.

The great number of such required on-and-off switching operations produce wear and tear. The stroke length and the number of strokes can be adjusted but over a relatively limited range of about ±10%.

While the prior art cable-operated long stroke pumpers constitute an improvement over the conventional beam-type pumpers, nevertheless they are still characterized by drawbacks chief among which are: they require large diameter drums, sheaves and cables; their cables become subjected to excessive wear; their electric prime movers require high torque gear boxes to rotate their drums and no other type prime movers can be employed; their physical dimensions and weights, while reduced as compared to the beam type pumpers, are still excessively large to make full enclosures practical, hence excessive wear on the pumper units; they are inherently restricted to the limited operational range they are designed for; their velocity and acceleration are not easily programmable; they are insensitive to downhole problems and will continue to work until a sensed overload will set an electronic brake, or until a catastrophic failure occurs; and should their single cable break on the wellside, the rods which will accelerate downwardly will buckle, the downhole pump will most likely become destroyed, and the production tubing damaged.

It is therefore a general object of the present invention to provide a universal long-stroke pumper (ULSP) which retains the advantages of prior art long-stroke pumpers while eliminating their above described and other known disadvantages.

SUMMARY OF THE INVENTION

The long-stroke pumping apparatus has a frame, a drum, and a pair of sheaves mounted on the frame. A traction cable is connected to the drum. A cable connector is connected to one end of the traction cable which is guided over one sheave into an oil well. A counterweight assembly is connected to the other end of the traction cable which is guided over the other sheave into a counterweight well. A reversible power means, preferably including a hydraulic motor, rotates the drum a number of turns in one angular direction and then in an opposite angular direction during one complete stroke of pumping operation. A load cable is supported and guided by the sheaves, and the cable connector and the counterweight assembly are also suspended from the load cable. The load cable is not drivingly connected to the drum.

Preferably, the pumping apparatus includes a plurality of load cables and at least two traction cables. The reversible power means is powered by a hydraulic system having a hydraulic control network and a hydrostatic transmission which includes a prime mover, a variable-delivery hydraulic pump driven by the prime mover, and the reversible hydraulic motor is powered by the pump. The hydraulic motor is preferably directly coupled to the drum. The hydraulic motor preferably has a stator shaft and a rotor directly coupled to the drum. The hydraulic control network includes means for independently controlling the rate of hydraulic power delivered by the pump to the motor during each up-stroke and down-stroke.

The pumping apparatus preferably further includes means for displacing the drum relative to the sheaves simultaneously with and in relation to the rotation of the drum by the hydraulic motor. The rate of such displacement of the drum is adjusted to produce a substantially zero fleet angle for the traction cable or cables during the entire cycle of pumping operation. The displacement of the drum is produced preferably by pivoting the drum, which can be achieved by mounting the drum on a support which is pivotably mounted on said frame. The hydraulic control network includes a servo loop for controlling the rotation of the drum and for pivoting the drum support in response to an error signal produced by a sensor device which senses the lateral position of a traction cable.

BRIEF DESCRIPTION OF THE DRAWINGS

FIGS. 3–8 are schematic illustrations of different cable arrangements suspended from the drum and sheaves useful for an understanding of certain theoretical considerations of the ULSP;

FIG. 9A is a side view of the drum and its movable platform;

FIG. 12 is a sectional view of the bottom part of the modified production well used with the ULSP of this invention;

FIG. 13 is a view on line 13—13 in FIG. 12; and

FIG. 14 shows the upper part of the modified production well.

DETAILED DESCRIPTION OF THE ULSP

Figure 1:
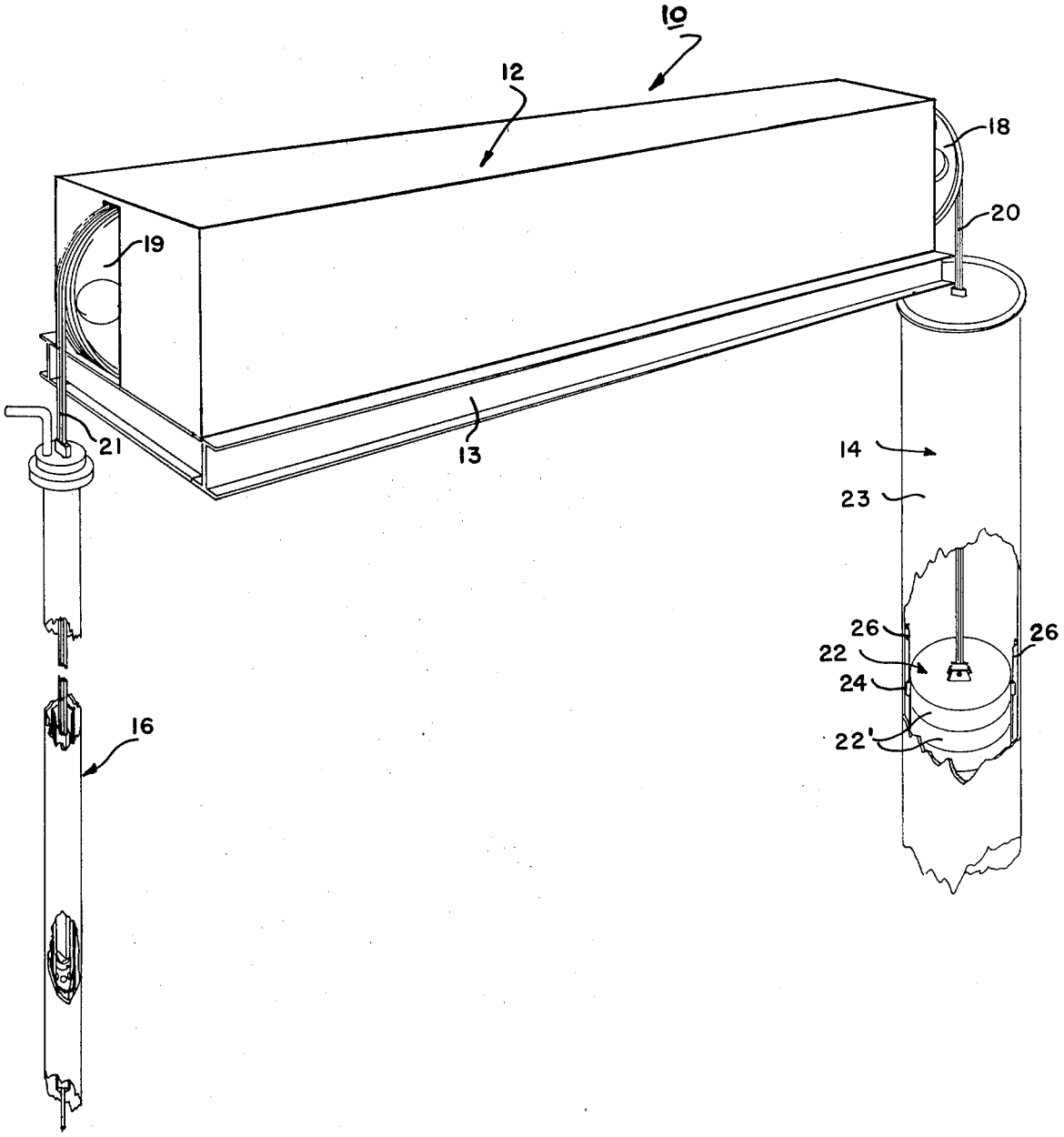
FIG. 1 is a perspective view of the overall ULSP showing the surface unit, the counterweight well, and the top section of the production well.

Throughout the drawings and to facilitate their understanding, the same reference characters will be used to refer to the same or similar parts. The description of conventional parts will not be given except when required for an understanding of the modifications brought about by the present invention.

The universal long-stroke pumper (ULSP) of this invention is generally designated as 10 (FIG. 1). It comprises a surface unit 12, a counterweight well 14, and a modified oil production well assembly 16. The surface unit 12 is disposed on the ground so that its front end is adjacent to well 16 and its rear end is adjacent to well 14. Unit 12 has a main frame 13 on which are mounted rear and front cable guides, preferably a rear sheave 18 and a front sheave 19, each sheave being rotatably mounted about a horizontal axis, the axis of sheave 18 being parallel to the axis of sheave 19. The circumferential surface of each sheave has a number of parallel grooves corresponding to the total number of cables employed. The greater the number of cables, the smaller can be the diameter of each cable and consequently the smaller can be the diameter of each sheave. Sheave 18 guides the set of cables 20 into the center of well 14. Sheave 19 guides a set of cables 21 into the center of well 16. The ends of cables 20 are attached in any convenient manner to a counterweight assembly 22 which can be made up of a plurality of discs 22'. The counterweight assembly 22 is guided on cam rollers 24 over diametrically-disposed, vertical rails or guides 26 which are welded to the pipe 23 forming well 14. In this fashion, well 14 need not be vertical with great accuracy. The guided counterweight 22 thus prevents the rotary motion of and twisting of the set of cables 20.

Figure 2:
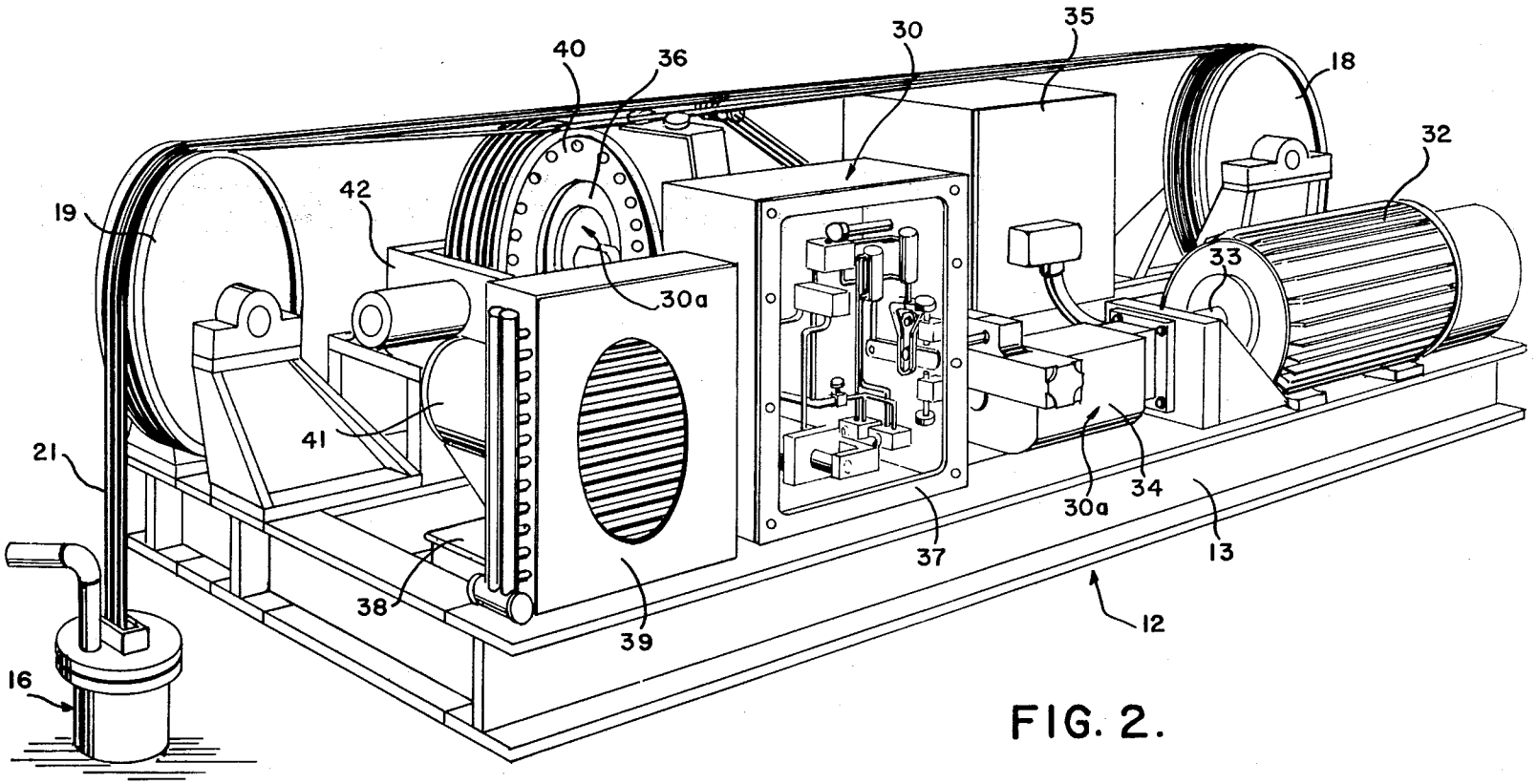
FIG. 2 is an enlarged perspective view of the surface unit shown in FIG. 1.

On the frame 13 (FIG. 2) of surface unit 12 is mounted a prime mover, which can be a diesel engine or an electric motor 32. An electric controller 35 controls the operation of motor 32. A hydraulic system 30 is provided which consists of a hydrostatic transmission **30*a* and of a hydraulic control network 37. Motor 32 has a shaft 33 directly coupled to the shaft of the hydrostatic transmission 30*a* which includes a variable-delivery pump 34. Pump 34 provides variable and reversible hydraulic power to a reversible hydraulic motor 36**.

The hydraulic control network 37 derives fluid from and rests on a hydraulic tank 38. Network 37 controls the entire operation of the ULSP 10. A heat exchanger 39 driven by a small hydraulic motor 41 removes heat from the hydraulic fluid in system 30. Motor 36 is of a type which can preferably be mounted in the center of, for driving directly, a drum 40 having a helical groove on its circumferential surface. To avoid excessive wear on the cables, drum 40 is rotatably mounted on a drum support 42. The drum's surface is controllably movable so that the fleet angle is substantially zero at all times. This can be accomplished for example by reversibly rotating the drum support 42 by a small angle about a horizontal axis perpendicular to the axis of the sheaves and passing through the center of the drum, at the same time as drum 40 rotates clockwise or counterclockwise. The same object can be accomplished by reversibly moving the drum support horizontally on a line parallel to the axis of the drum, or by any other means reversibly moving or displacing the drum in a line parallel to the drum's axis, although it is presently preferred to pivotably mount the drum support, as shown in the drawings.

Figure 3:
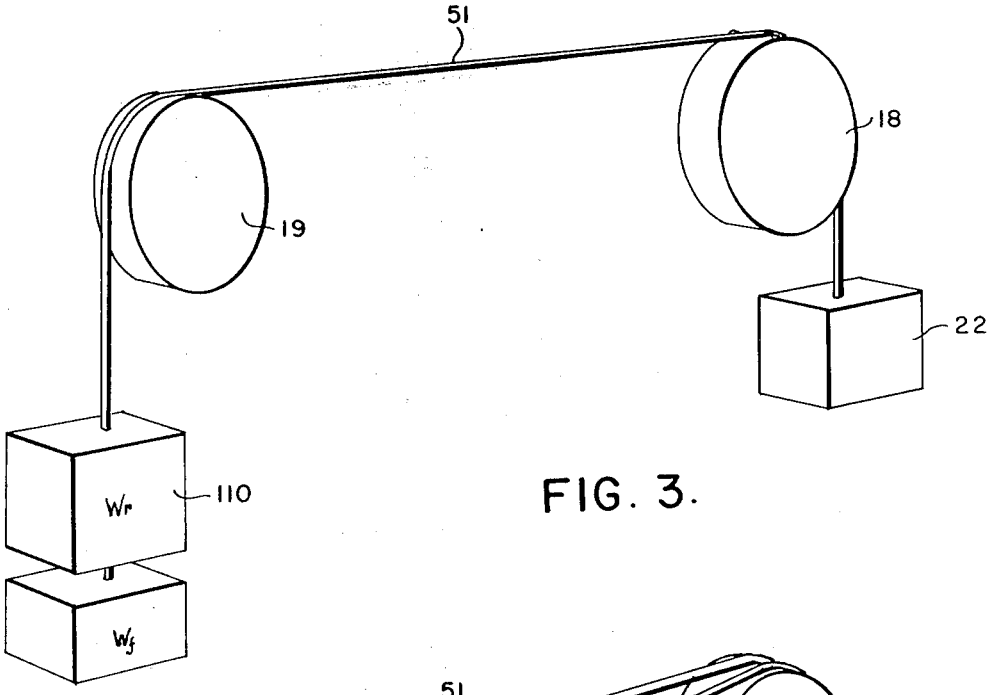

Before proceeding with the further description of the ULSP 10, it will be helpful to first describe certain theoretical aspects of the invention with reference to FIGS. 3–8. FIG. 3 illustrates a single cable 51 guided over sheaves 18 and 19. Attached to the rear end of cable 51 is counterweight 22 having a weight Ci. Attached to the front end of cable 51 is a sucker rod string 110 which is conventionally represented by a weight Wr that carries, on the upstroke only, a fluid weight Wf. The counterweight 22 is selected so as to satisfy the following relationship:

$$Ci = Wr + Wf/2 \quad (1)$$

Equation 1 for the sake of simplicity does not take into consideration friction, buoyancy of the sucker rod string 110, and other factors of secondary importance.

Figure 4:
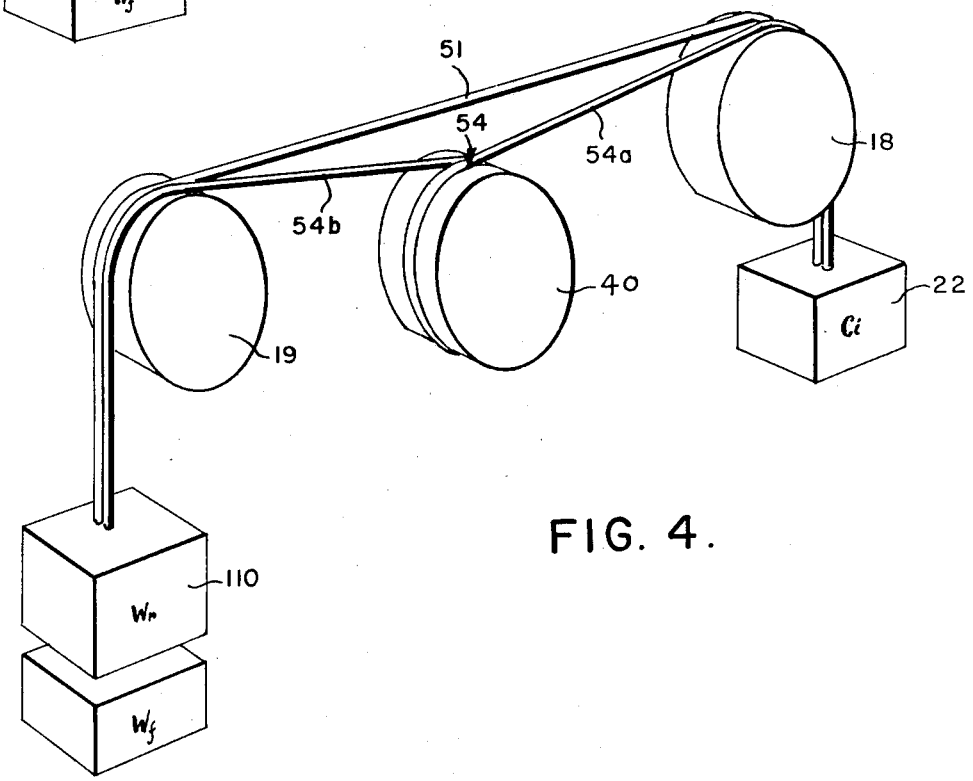

Cable 51 will hereinafter be referred to as a "load" cable to distinguish it from a traction cable, generally designated as 54 (FIG. 4). The load cable 51 is not drivingly connected to the drum 40. Traction cable 54 consists of a half-traction cable **54*a* on the counterweight side and of a half-traction cable 54*b* on the sucker rod side. The helically grooved surface of drum 40 has n turns between two end points 40*a* and 40*b* (FIG. 5). Half-traction cable 54*a* has one end anchored at 40*a* and its other end attached to counterweight 22. Half-traction cable 54*b* has one end anchored at 40*b* and the other end attached to the rod string 110. Cables 54*a* and 54*b* always exit from drum 40 from two adjacent grooves. When drum 40 is fully rotated clockwise, cable 54*b* is fully wound up and cable 54*a*** is fully unwound, and vice versa.

It is desired for the load cable 51 and the traction cable 54 to be of equal strength and of the same diameter. The load and traction cables 51 and 54 will carry the same loads provided that the following relationship is satisfied:

$$Wf \leqq 2\ Wr \quad (2)$$

FIG. 6 illustrates the case wherein two load cables 51, 52 and one traction cable 54 are employed. In order for all the cables to share the loads equally, the following relationship must be satisfied:

$$Wf/2 \leqq Wr/2 \quad (3)$$

For small to medium size loads, the utilization of two load cables and one traction cable will be sufficient. For large size loads, it will be convenient to employ three load cables 51, 52, 53 and two traction cables 54, 55 (FIG. 7). To accommodate two such traction cables, the drum surface is provided with a double helical groove in which the two traction cables are wound side by side (FIG. 8). Half-traction cables 54*a*, 55*a* are anchored to adjacent end points 40*a*, 40*a'*, respectively, at one end of the drum and half-traction cables 54*b*, 55*b* are anchored to adjacent end points 40*b*, 40*b'*, respectively, at the opposite end of the drum.

In order for the five cables 51–55 to share the loads equally, the following relationship must be satisfied:

$$\tfrac{1}{2}Wf/2 \leqq Wr/3 \text{ or } Wf \leqq 4/3\ Wr \quad (4)$$

In general, in the case wherein n traction cables and m load cables are employed, the loads will be shared equally by all the cables provided that the following relationship is maintained:

$$Wf \leqq 2n/m\ Wr \quad (5)$$

In sum, while the load cables are not essential, they are highly desirable since they serve to separate the traction effort from the static load, thereby leaving to the traction cables the job of providing the necessary pull for the fluid production load Wf.

Figure 9B:
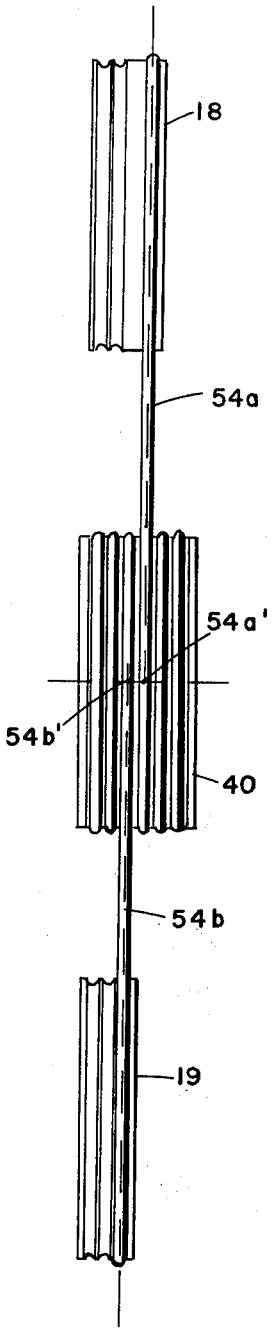
FIG. 9B shows the alignment between the traction cables and their respective grooves on the sheaves when the drum's axis is horizontal.

When the drum's longitudinal axis is horizontal (FIG. 9), then the exit point 54*a'* (FIG. 9B) of the half-traction cable 54*a* from the drum will be in alignment with its corresponding groove on sheave 18, and the exit point 54*b'* of the half-traction cable 54 will be in alignment with its corresponding groove on sheave 19. The exit points 54*a'* and 54*b'* are adjacent to each other near the center of the drum's surface.

In order for the fleet angles of the two half-traction cables to be at all times substantially zero, i.e., in order for each half-traction cable to continuously remain in alignment with the groove on the sheave, the drum's support 42 is made to pivot about an axis passing through the centers of stub shafts 42*a*, 42*b* (FIG. 9A). Stub shaft 42*a* is journaled in a pair of thrust bearings 42*c* and in a load bearing 42*d*. Stub shaft 42*b* is journaled in a load bearing 42*e*. The angular rotation of stub shafts 42*a*, 42*b* to which the support 42 is secured will determine the angle of tilt imparted to the longitudinal axis of the drum. The greater the number of turns of the traction cable on the drum's surface, the greater will this angle of tilt have to be.

Figure 9C:
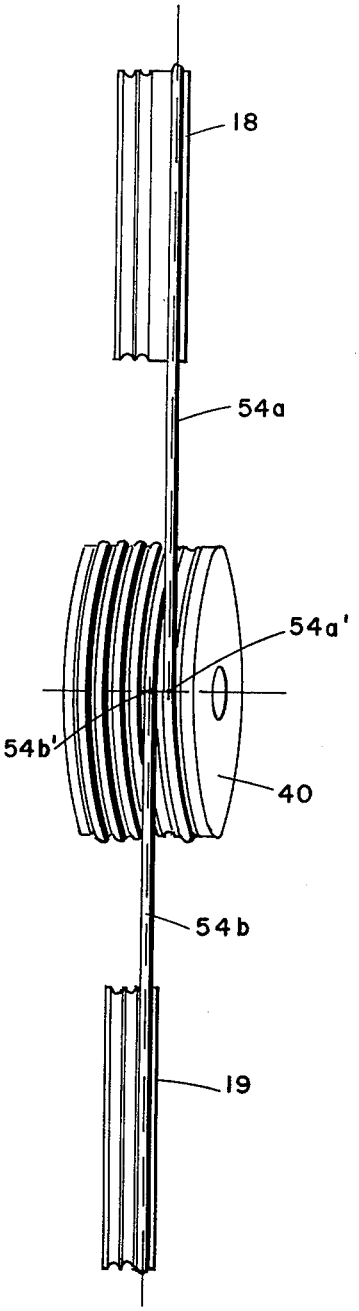
FIG. 9C shows the same alignment when the drum's axis is maximally tilted upwardly relative to the horizontal.

When the drum is fully rotated clockwise, as viewed in FIG. 9C, cable 54*b* is fully wound and cable 54*a* is fully unwound, so that their respective exit points 54*b'*, 54*a'* will be at one end of the drum. The drum's support 42 is then fully tilted counter-clockwise so that exit points 54*a'*, 54*b'* again remain in alignment with their grooves on sheaves 18, 19. Conversely, when the exit points 54*a'*, 54*b'* are at the opposite end of the drum, the support 42 is then fully tilted clockwise, so that exit points 54*a'*, 54*b'* again remain in alignment with their corresponding grooves on sheaves 18, 19.

Thus during a full cycle of pumping operation, i.e., a complete up and down stroke, support 42 first gradually tilts counter-clockwise and then clockwise. The oscillations of support 42 achieve a very important function which consists of substantially removing the lateral friction which would otherwise exist in the half-traction cables. Although the tension itself within the half-traction cables would be sufficient to tilt support 42 in order to maintain the exit points 54*a'*, 54*b'* in alignment with their respective grooves on their respective sheaves, in order to remove all side-loads it is preferred to apply an assist torque to the stub shaft 42*b*, as will subsequently be described. Thus while the drum rotates about its longitudinal axis to provide a long stroke, the drum's longitudinal axis is tilted so that the exit points of the half-traction cables remain lines up with the grooves on their respective sheaves.

Figure 10:
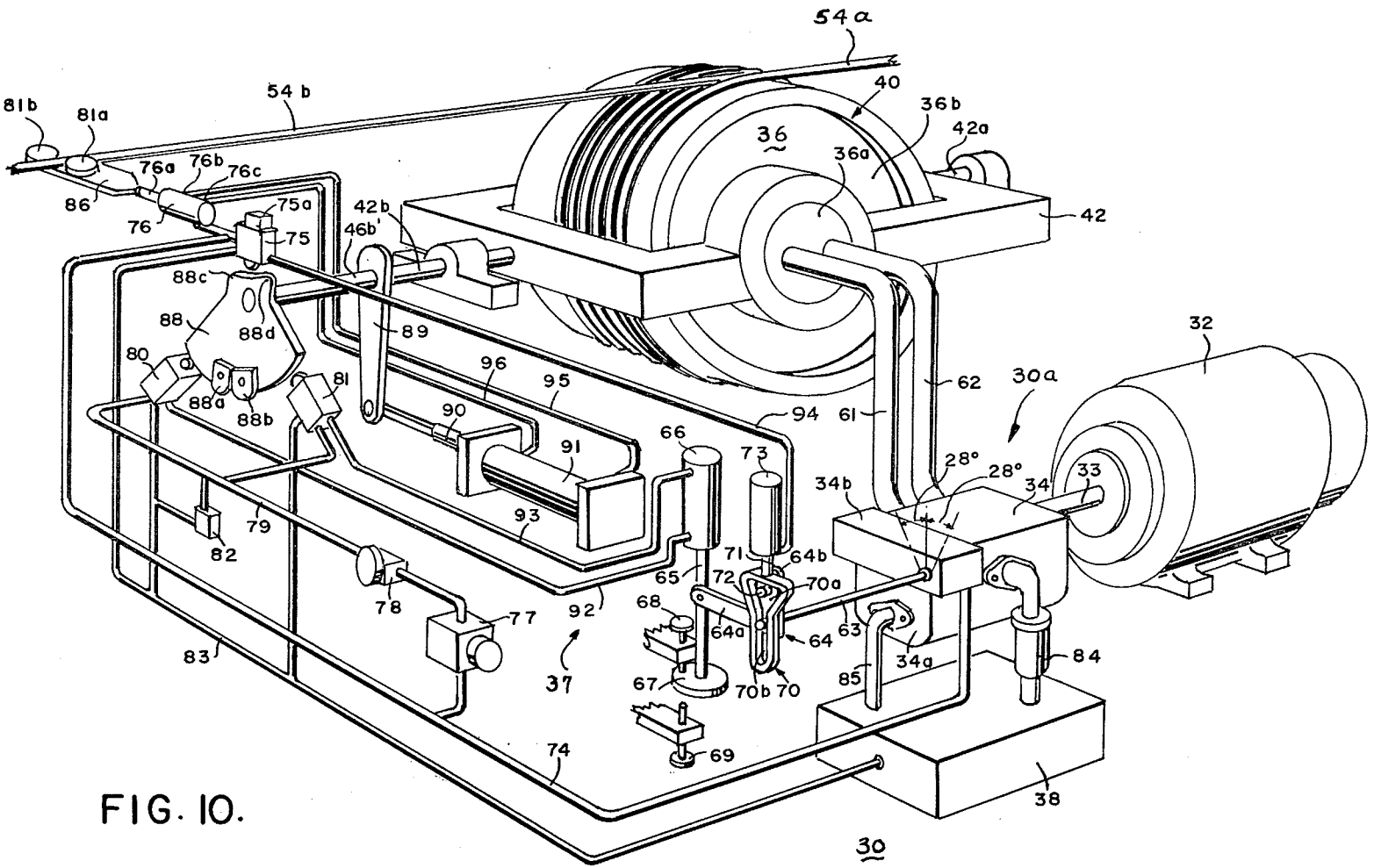
FIG. 10 is a schematic and exploded view of the hydrostatic transmission and of hydraulic control network.

The hydraulic system 30 (FIG. 2) will now be described in greater detail (FIG. 10). The hydrostatic transmission 30*a* includes the electric motor 32 whose shaft 33 is coupled to the variable-delivery hydraulic pump 34 that delivers hydraulic power through a pair of flexible, high-pressure lines 61, 62 to the stationary shaft or stator 36*a* of the hydraulic motor 36. Although any high-torque, low-speed hydraulic motor can be employed, a Hägglunds series 40 motor, sold by the Bird-Johnson Company, is preferred. Its rotor 36*b* is secured to drum 40. The stator 36*a* is stationary on frame 42. For clockwise rotation of rotor 36*b*, high-pressure oil flows into line 61 and returns through line 62. Conversely, for counterclockwise rotation, high-pressure oil flow into line 62 and returns through line 61. The front section of the main pump 34 contains an auxiliary charge pump 34*a* and a servo control 34*b* which controls the delivery of the main pump 34. A rotatable shaft 63 extends outwardly from the servo control 34*b* and its free end is connected to an L-shaped control link 64, one leg 64*a* of which is connected to the rod 65 of a hydraulic cylinder 66, and its other leg 64*b* carries a pin 72. Rod 65 carries a disc 67 which is movable between two stop members such as threaded bolts 68, 69. Shaft 63 extends through the base of link 64 into the leg 70*b* of an override link 70 having a Y-guide. Pin 72 rides inside the head section 70*a* of the Y-guide, as shown. The override link 70 is secured to the rod 71 of a hydraulic cylinder 73.

The charge pump 34*a* supplies fluid to the hydraulic control system 37 through line 74 which feeds: a pair of spring-loaded, four-way control valves 75, 76; a pressure regulator 77; and a flow regulator 78. The output from regulator 78 is fed through a line 79 to a pair of spring-loaded four-way control valves 80, 81, and to a relief valve 82 whose output is returned through a drain line 83 to the oil tank 38. The output from oil tank 38 flows through a filter 84 into the charge pump 34*a*, and the excess oil is returned to the tank through a line 85.

Valve 76 has a shaft 76*a* which is mechanically coupled to a plate 86 that carries two spaced-apart cam rollers 81*a*, 81*b* between which passes the traction cable 54*b* connected to the sucker rod 110. Secured to the free end of an extension 46*b'* of shaft 42*b* is a cam plate 88 that operates valves 75, 80, and 81. Plate 88 has a bottom arcuate section which carries two adjustably positioned cams 88*a*, 88*b* that operate the shafts of valves 80, 81, respectively. Cams 88*a* and 88*b* are normally positioned next to each other near the center of the arcuate section of plate 88 (FIG. 10), and then the maximum number of traction cable turns will be wrapped and unwrapped on and from drum 40. When cam 88*a* is moved to the left of center, the number of turns that cable 54*a* will wrap aroung the drum will be reduced and cable 54*b* will equally unwrap a lesser number of turns. The reverse happens when cam 88*b* is moved to the right of center. The particular position of either cam 88*a* or 88*b* is determined by the operator prior to starting the pumping operation.

Valve 75 is actuated by lobes 88*c* and 88*d* on the opposite sides of the top end of cam plate 88. Valve 75 controls an electric switch 75*a* which is a fail-safe device that functions only in the vent that the control provided by valves 80, 81 fails. Valve 75 will be actuated by lobe 88*c* or 88*d* before the half-traction cable 54*a* or 54*b* reaches the end of the drum.

The extension shaft 46*b* ' also carries a lever arm 89, the outer end of which is pivotally connected to the rod 90 of a hydraulic cylinder 91. The output from valve 80 is fed through a line 92 to one inlet of hydraulic cylinder 66. The outlet of valve 81 is coupled through a line 93 to the other inlet of cylinder 66. The output of valve 75 is coupled through a line 94 to one inlet of hydraulic cylinder 73. Outlets 76*b*, 76*c* of valve 76 are connected through lines 95, 96, respectively, to the two inlets of hydraulic cylinder 91.

In operation of the hydraulic system 30, when shaft 63 is at its neutral or center position, no oil is flowing in either line 61 or line 62, even though pump 34 is being rotated at full speed by shaft 33 of electric motor 32. When shaft 63 is rotated counterclockwise to its extreme position, by an angle of say 28°, as viewed in FIG. 10, oil will flow into hydraulic motor 36 through line 62 and will return to pump 34 through line 61. Rotor 36*b* and therefore drum 40 will rotate at full speed in a counter-clockwise direction. Conversely, when shaft 63 is rotated clockwise from its center position to its extreme position, oil will flow into line 61 and will return through line 62. Rotor 36*b* and drum 40 will rotate at full speed in a clockwise direction. The angular speed of rotor 36*b* will depend on the angular deviation of shaft 63 from its center position, because the volume of oil delivered by pump 34 is proportional to the angular deviation of shaft 63 from its center position.

The angular rotation of shaft 63 is produced by the up and down movements of rod 65 which are translated into rotary motion by link 64. Since the movements of rod 65 are limited by the stop members 68, 69, the rotation of shaft 63 in either direction will also be limited by the same stop members. As a result, stop member 69 will limit the maximum counter-clockwise speed of drum 40, and stop member 68 will limit the maximum speed in a clockwise direction.

In the event of an emergency, rod 71 will contract, thereby confining pin 72 within the leg 70*b* of the Y-guide in the override link 70. Such action has the effect of returning shaft 63 to its neutral or center position, so that no fluid will flow in either line 61 or line 62, thereby stopping drum 40.

The cam rollers 81*a*, 81*b* sense the lateral movements of half-traction cable 54*b*. When cable 54*b* is in alignment with its corresponding groove on sheave 19, then shaft 76*a* of valve 76 will be in its neutral position and no oil will flow through lines 95, 96. Should the half-traction cable 54 become laterally displaced from its alignment position by a predetermined amount, on either side from the neutral position, then either cam 81*a* or cam 81*b* will transfer a force or "error" signal through plate 86 to shaft 76*a* of valve 76 in a direction corresponding to the direction of the displacement of cable 54*b*. The movements of shaft 76*a* will cause oil to flow in either line 95 or line 96, thereby causing either an extension or contraction of rod 90. The linear movements of rod 90 are translated into angular rotation of lever 89 and therefore of shaft 42*b*. The rotation of shaft 42*b* will produce a corresponding rotation of the drum's support 42 and, hence, a tilt of the longitudinal axis of drum 40 in a vertical plane about the center of the drum. The rotation of support 42 and hence the angle of tilt of the drum's longitudinal axis will be in a direction so as to remove the lateral displacement of cable 54*b* and bring it back into alignment with the groove on sheave 19. In this manner the fleet angle will be substantially zero at all times.

The charge pump 34*a* will supply oil through line 74, at a pressure of say 200 psi, to valves 75, 76 and to a pressure regulator 77 adjusted to about 25 psi. The output of regulator 77 is fed through a flow valve 78 which can be regulated from 100 to 400 cubic inches per minute. The regulated outflow of oil from regulator 78 flows through line 79 into valves 80, 81 whose shafts are movable by cams 88*a* and 88*b*, respectively. The positions of cams 88*a*, 88*b* will be manually adjusted depending on the number of drum revolutions desired during each half cycle of pumping operation, and hence on the length of each desired up-stroke or down-stroke.

When valve 80 becomes actuated by cam 88*a*, oil will flow through line 92 into cylinder 66 thereby causing its rod 65 to contract, which in turn causes link 64 and control shaft 63 to rotate clockwise. The rotation of shaft 63 clockwise forces pump 34 to reduce its rate of oil delivery through line 62 to zero, and then to resume delivery through line 61 up to a maximum rate determined by the position of bolt 68. When valve 81 becomes actuated by cam 88*b*, oil will flow through line 93 into cylinder 66 thereby extending rod 65 and causing link 64 and control shaft 63 to rotate counterclockwise. As a consequence, pump 34 will reduce its rate of delivery through line 61 to zero and resume delivery through line 62 to a maximum rate determined by the position of bolt 69. Thus the rotation of shaft 63 in a clockwise direction first reduces the speed of drum 40 in a counterclockwise direction to zero, and then reverses the drum's rotation to a clockwise direction. Thus during each full cycle of pumping operation, drum 40 will accelerate clockwise and then accelerate counter-clockwise.

The transition from clockwise to counter-clockwise, rotation, and vice versa, is achieved smoothly and continuously at a rate determined by a fluid flowing through flow valve 78. The adjustment of flow valve 78 will determine the speed at which rod 65 of cylinder 66 can extend or contract and, therefore the rate of acceleration and deceleration of drum 40. Hence, flow valve 78 provides a convenient means for controlling the acceleration and deceleration of the drum.

When valve 75 becomes actuated by cam 88*c* or 88*d*, it will allow oil to flow into cylinder 63 thereby causing rod 61 to contract, whereby override link 70 moves up and link 64 is brought to its neutral position, the results of which have previously been described. The power exerted by cylinder 73 can overcome the resistance offered by cylinder 66, because the pressure line 79 is returned to the drain line 83 through a relief valve 82 set at 35 psi. When valve 75 becomes actuated, electric switch 75*a* will interrupt the flow of current to motor 32. The re-energization of motor 32 can be effected manually after the malfunction has been repaired.

Figure 11:
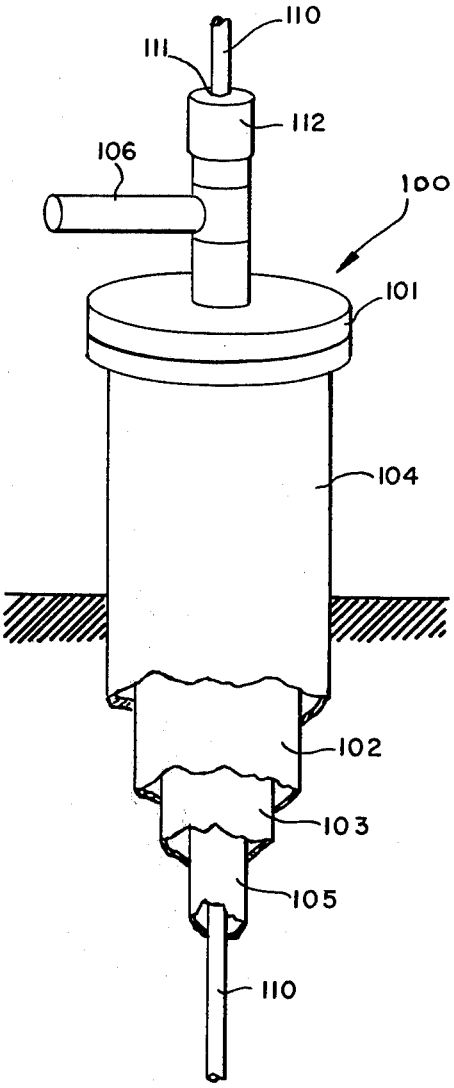
FIG. 11 shows a conventional wellhead for sucker rod pumping.

With reference to FIG. 11, a conventional well head, generally designated as 100, comprises a casing head 101 which supports concentric casing strings 102, 103, and production tubing string 105 that terminates above the well head in a T-pipe 106 that allows the production fluid to flow from the production tubing 105 into a pipeline. Casing head 101 is supported by the outer casing 104. Inside the production string 105 is positioned the polished sucker rod 110.

A stuffing box 112 mounted on rod 110 provides a seal fixed between the production string 105 and the polished rod 110. In this manner the polished rod 110 can move up and down without any oil escaping where the polished rod leaves the well head at point 111.

With reference now to FIGS. 12–14, the well head used with the ULSP 10 of this invention is generally designated as 120. It comprises an enlarged diameter production string 122. To the bottom end of string 122 is coupled a swaged nipple 124 which serves as a transition coupler between the large diameter string 122 and the reduced diameter production string 105. A short piece of production pipe 105 extends into the lower end of the swage nipple 124 and is welded thereto at a point 123. Pipe 105 is provided above point 123 with a plurality of radially spaced-apart orifices 126 which allow the production oil to discharge into a fluid reservoir chamber 127. Welded near the uppermost end of the production pipe 105 is an annular ring 130 which supports a tubular section 131 that surrounds production pipe 105 and is sealed therefrom by one or more O-rings 132. The upper end of section 131 is attached to a conically-shaped section 133 which then changes to a rectangular cross-section. The bottom end 134 of a rectangular cross-section. The bottom end 134 of a rectangular cable guide 136 is welded to section 133. An annular ring 129 supports seals 138 the movement of which is stopped by an upper ring 140.

The polished rod 110 extends through seals 138 and terminates in a clevis 142 which is attached to a cable connector plate 144, also preferably having a rectangular cross-section. Plate 144 is provided with opposite cam rollers 146 which will permit the plate to move easily inside the rectangular guide 136. The set 21 (FIG. 1) of cables from the sheave 19 are secured to plate 144 by any suitable means.

The well head 120 includes the outer casing 104, one or more intermediate casings 102, the enlarged diameter production string 122, and the cable guide 136 which will protrude from the well head through a top plate 148. A discharge tube 150 connects the fluid reservoir chamber 127 with the production pipeline.

In one embodiment of the invention, the frame was 12′ long and 5′ wide, the sheaves had a 33-inch diameter and carried five ¾-inch cables side by side, three of which were load cables and two were traction cables. For a well head using a 2-inch or 2.5-inch production string 105, the uppermost 45-foot section thereof was replaced with a 4.5 inch enlarged diameter string 122. A 24-inch swage nipple acted as a transition coupler between the 4.5-inch and 2-inch production tubings 105. A short 2-inch pipe 105 extended into the nipple a distance of about 15-inches and was provided with six circumferentially- spaced ports. The rectangular cable guide section 136 guided the set 21 of cables without twisting them and without putting pressure on the seals of the stuffing box which can be conventional, but self-adjusting hydraulic cylinder type seals are preferred. The drum was 11-inches wide and had a diameter of 32-inches. The drum's surface had two parallel helical grooves, each groove had 6.5 turns. For a ¾ inch cable, the depth of the groove was about 0.35 inches. For a 40-foot stroke, 4.6 turns of the drum were required. As the counterweight appears heavier on a down-stroke (without fluid load) and ligher on the up-stroke (with fluid load), the sytem cannot freewheel. If the traction cables are removed the system will stop.

ADVANTAGES OF THE ULSP

The advantages of the ULSP can be summarized with reference to the examplary dimensions above given as follows: its forty-foot long stroke produces highly efficient pumping at one to five strokes per minute with long rod life and low acceleration; its multi-load cables allow the sheaves and the drum to have relatively small diameters requiring lower drive torques that can be produced from a hydrostatic transmission with a variable delivery pump; its hydraulic control system can independently vary the speed, stroke and acceleration thereby having the capability of adjusting the ULSP operation exactly to the required well's conditions for optimum efficiency of operation; its hydraulic control network also permits to tune the ULSP so as to provide lowest torque and equal workloads in both up and down motion for maximum efficiency. The control network includes hydraulic safety devices which continuously sense well problems and are capable of shutting down the pumping operation whenever an abnormality occurs, for example, an instanteous excessive overload will instantaneously open a hydraulic safety release valve which will shut down the operation of the ULSP; a single mechanical embodiment of the ULSP can be driven with different hydrostatic transmissions so that the single mechanical ULSP is universal and can replace virtually the whole range of conventional beam-type pumpers; its physical dimensions can be such that the required amount of steel is considerably reduced, say by a factor 5 to 8, as compared to conventional long-stroke pumpers; and therefore, its reduced physical dimensions now make it practical to completely enclose the ULSP thereby protecting it from adverse environmental effects and making it less objectionable to the aesthetic appearance of the pumping site. Other advantages will become readily apparent to those skilled in the oil well pumping art.

What is claimed is:

1. In a long-stroke pumping apparatus comprising: a rotatable drum, a pair of rotatable sheaves, traction cable means drivingly connected to said drum for transmitting the torque produced by said drum, cable connector means connected to one end of said traction cable means which is guided over one sheave into an oil well, a counterweight assembly connected to the other end of said traction cable means which is guided over the other sheave into a counterweight well, reversible power means for rotating said drum a number of turns in one angular direction and then in an opposite angular direction during one long cycle of pumping operation; the improvement wherein said reversible power means includes a hydraulic system having a hydraulic control network and a hydrostatic transmission, said transmission including: a prime mover, a variable-delivery hydraulic pump driven by said prime mover, and a reversible hydraulic motor powered by said pump and being directly coupled to said drum; and load cable means coupled to said cable connector means through said one sheave and to said counterweight assembly through said other sheave, said load cable means being drivingly unconnected to said drum.

2. The pump apparatus of claim 1, wherein said hydraulic motor has a stator shaft and a rotor which is directly coupled to said drum.

3. The pump apparatus of claim 1, wherein said control apparatus includes means for independently controlling the rate of hydraulic power delivered by said pump to said motor during each half cycle of pumping operation.

4. The pump apparatus 3, and means for moving said drum relative to said pair of sheaves simultaneously with and in relation to the rotation of said drum by said hydraulic motor.

5. A universal long-stroke pumping apparatus comprising:

a frame, a drum support rotatably mounted on said frame, a helically grooved drum rotatably mounter on said drum support, a rear multi-grooved sheave mounted for rotation about a horizontal axis on said frame on the side of a counterweight well, a front multi-grooved sheave rotatably mounted on said frame on the side of an oil well, at least one load cable supported on and guided by said sheaves into said counterweight well and into said oil well, traction cable means connected to and extending from said drum over said rear sheave into said counterweight well and over said front sheave into said oil well, a hydraulic system including: a hydrostatic transmission having a hydraulic motor directly coupled to said drum, and a variable-delivery pump hydraulically coupled to said motor; a primer mover for driving said hydrostatic transmission, and a hydraulic control network causing said hydraulic motor to rotate clockwise during one-half cycle and counter-clockwise during the other half-cycle of pumping operation, whereby said traction cable means effectuate in their respective wells a long stroke, a sensing device for producing an error signal dependent upon the lateral movements of said traction cable means, and said control network being responsive to said error signal for moving said drum support in a direction so as to reduce said error signal.

6. A universal long stroke pumping apparatus for oil well pumping and the like comprised of:

(i) a reversible power means, (ii) a rotatable grooved drum operatively connected to be periodically rotated by said power means during a pumping cycle of said apparatus, (iii) a pair of spaced-apart cable guide means, (iv) traction cable means being drivingly coupled to said drum for operatively connecting said drum through said guide means to a pumping string and to counterweight which at least partially counterbalances the weight of the pumping string, the improvement including:

load cable means for carrying the loads of said pumping string and of said counterweight, said load cable means being drivingly unconnected to said drum.

7. The pumping apparatus of claim 6, wherein said load cable means are supported on and guided by said cable guide means.

8. The pumping apparatus of claim 7, wherein said traction cable means includes at least two traction cables.

9. The pumping apparatus of claim 7, wherein said reversible power means includes a control network, a prime mover, a variable-delivery hydraulic pump driven by said prime mover, a reversible hydraulic motor powered by said pump, and said drum being driven by said reversible hydraulic motor.

10. The pumping apparatus of claim 9, wherein said hydraulic motor is directly coupled to said drum.

11. The pumping apparatus of claim 9, wherein said hydraulic motor has a stator shaft and a rotor, and said rotor is directly coupled to said drum.

12. The pumping apparatus of claim 11, wherein said variable-delivery pump includes means for controlling the rate of hydraulic power delivered by said pump to said motor.

13. The pumping apparatus of claim 9, and moving means for displacing said drum relative to said pair of cable guide means while said drum is being rotated by said reversible power means.

14. The pumping apparatus of claim 13, wherein said moving means cause said traction cable means to maintain a substantially zero fleet angle during the pumping cycle.

15. The pumping apparatus of claim 13, wherein said moving means pivot said drum about an axis which is substantially perpendicular to the axis of said drum and in substantially the same plane which contains the drum axis.

16. The pumping apparatus of claim 13, wherein said moving means include a drum support which is pivotally mounted about a shaft whose axis is perpendicular to the axis of said drum.

17. The pumping apparatus of claim 16, wherein said control system includes servo loop means for controlling the rotation of said drum and the pivoting of said drum support.

18. The pumping apparatus of claim 17, wherein said servo loop means include sensor means for sensing the lateral position of said traction cable means on said drum.

19. The pumping apparatus of claim 18, wherein each cable guide means is a grooved sheave.

20. The pumping apparatus of claim 19, and cam means coupled to said shaft, and means responsive to said cam means for controlling the delivery rate of said pump.

21. The pumping apparatus of claim 17, and hydraulically operated means for rotating said shaft.

22. The pumping apparatus of claim 16, wherein said control network includes servo loop means for controlling the acceleration of said drum.

23. The pumping apparatus of claim 16, wherein said control network includes means for stopping the rotation of said drum.

24. The pumping apparatus of claim 9, wherein said control network includes means for stopping the delivery of hydraulic fluid from said pump to said motor, and means for stopping said prime mover.

25. In a long-stroke pumping apparatus comprising: a frame, a drum support pivotally mounted on said frame, a drum rotatably mounted on said support, a pair of cable guide means mounted on said frame, traction cable means drivingly coupled to said drum, cable connector means connected to one end of said traction cable means, a counterweight connected to the other end of said traction cable means, reversible power means for rotating said drum, means including a closed servo loop means for controlling the rotation of said drum support simultaneously with and in relation to the rotation of said drum by said reversible power means, the rotation of said drum support being dependent upon the fleet angle of said traction cable means, a sensor means for sensing the instantaneous lateral positions of said traction cable means and for producing a corresponding error signal, said rotation of said drum support being controlled by said error signal produced by said sensor means.

26. The pumping apparatus of claim 25, and means responsive to said error signal for rotating said drum support in a direction so as to reduce said error signal.

27. The pumping apparatus of claim 25, wherein said drum support is rotated so as to maintain a substantially zero fleet angle for said traction cable means.

* * * * *